US009239204B2

(12) United States Patent
Michal et al.

(10) Patent No.: US 9,239,204 B2
(45) Date of Patent: Jan. 19, 2016

(54) GUN BARREL CAPS

(71) Applicants: Frank Michal, Medina, OH (US); Michael E. Stein, New Philadelphia, OH (US)

(72) Inventors: Frank Michal, Medina, OH (US); Michael E. Stein, New Philadelphia, OH (US)

( * ) Notice: Subject to any disclaimer, the term of this patent is extended or adjusted under 35 U.S.C. 154(b) by 0 days.

(21) Appl. No.: 14/554,177

(22) Filed: Nov. 26, 2014

(65) Prior Publication Data

US 2015/0308781 A1 Oct. 29, 2015

Related U.S. Application Data

(60) Provisional application No. 61/909,132, filed on Nov. 26, 2013.

(51) Int. Cl.
*F41A 35/02* (2006.01)
*F41A 35/04* (2006.01)

(52) U.S. Cl.
CPC ..... *F41A 35/04* (2013.01)

(58) Field of Classification Search
USPC ..... 42/96, 90, 106
See application file for complete search history.

(56) References Cited

U.S. PATENT DOCUMENTS

| | | | | | |
|---|---|---|---|---|---|
| D271,126 | S * | 10/1983 | Doak | | 42/96 |
| 4,817,322 | A * | 4/1989 | Dietz | F41A | 35/04 42/96 |
| 5,105,571 | A * | 4/1992 | Kinchin | F41A | 35/04 42/96 |
| 2006/0277812 | A1* | 12/2006 | Cole | F41A | 35/04 42/96 |
| 2010/0170135 | A1* | 7/2010 | Tompkins | F41A | 35/04 42/96 |
| 2011/0000122 | A1* | 1/2011 | Camarillo | F41A | 35/04 42/96 |

* cited by examiner

*Primary Examiner* — J. Woodrow Eldred
(74) *Attorney, Agent, or Firm* — Black McCuskey Souers & Arbaugh, LPA

(57) ABSTRACT

A barrel cap for attachment to a muzzle of a gun barrel and to cover the muzzle opening of the gun barrel.

1 Claim, 4 Drawing Sheets

GUN BARREL CAPS

RELATED APPLICATIONS

This application is related to U.S. provisional patent application No. 61/909,132, filed Nov. 26, 2013.

BACKGROUND

Gun barrels must be kept as clean as possible for reliable operation of the firearm. Use in extreme environments and in combat presents multiple opportunities for dirt and debris to enter the barrel through the muzzle and thereby foul the weapon. This can result in permanent damage to the interior surface of the barrel and/or disabling of the gun. Because gun muzzles heat to very high temperatures during use, particular in semi and fully automatic firing modes, it has not been practical to cover or protect the barrel particularly at the muzzle end.

SUMMARY

The present disclosure and related inventions provides gun barrel caps which fit tightly and securely upon a wide variety of gun barrels at the muzzle to fully protect the barrel from contaminants entering the barrel, and to protect operators from burns from the muzzle after firing. The barrel caps are preferably made of high strength and high temperature resistant polymeric material, and may be molded of a polymeric material and preferably an elastic polymer or "elastomer" and thermoplastic elastomers which exhibit viscoelasticity in durometers in the approximate hardness ranges of, for example, 5 Shore A to 90 Shore A, 40 Shore A or lower and up to 80 Shore A, and a more preferred range of 40 Shore A to 70 Shore A, and an even more preferred range of 50 Shore A to 70 Shore A, and an even more preferred range of 35 Shore A to 60 Shore A. Such materials include, for example, one or more of the following: synthetic rubber, natural rubber, neoprene, butyl rubber, silicone, urethane, viscoelastic urethane, nylon, PVC, polyethylene, polystyrene, polypropylene, PVB, PVDF or Nanbrol®, a nano-particle reinforced nitrile butadiene rubber (NBR), and thermoplastic polymer alloys with SBR, EPDM or urethanes as base polymers and blended to optimize dynamic properties, dimensional stability and elasticity, thermal resistance and fatigue performance. Additives which can be used with these materials in the manufacture of the gun barrel caps of the present disclosure include glass beads, Expandacel™, Kevlar™, Mylar™, fiberglass, cotton or other woven or non-woven materials in internal layers with the gun barrel caps. Additives or coatings (such as for example Nomex™ or Nitrile™) can be selectively incorporated into the gun rail attachment body material or design for improved heat resistance, durability, strength, tackiness or surface friction, or any other desired properties.

The use of thermoplastic polymers in these hardness ranges for gun barrel caps and components has numerous advantages, a principal one of which is a far superior gripping structure and feel than the relatively much harder rail cover attachments of the prior art. The use of viscoelastic materials in the disclosed hardness ratings provides numerous advantages over the much harder plastic rail covers of the prior art. The gun barrel caps provide a gripping structure and surface which can be squeezed as a relatively soft grip over the barrel muzzle, dramatically improving the secure handling of a gun and provide shock and recoil absorption, vibration dampening—including automatic or semi-automatic fire recoil and recoil vibration, resistance to moisture and grease, a high friction gripping surface even when wet, temperature insulation, reduction of infra-red signature and mirage effect, sound insulation and noise reduction and cushioning, an improved mounting surface for the gun barrel, protection against operator burns, damage protection for the gun, and other advantages and benefits as further described herein. A preferred material compound resists extreme heat and cold temperature fluctuations and will maintain its flexibility and tactile feel in a wide range of environments. The gun barrel caps made of the disclosed materials have superior thermal insulative properties and can withstand when mounted on a rail on a gun radiated barrel temperatures as high as 1500 degrees F. or higher. When installed on one or more rails of a gun, the attachments 10 effectively and substantially reduce heat transfer and the infrared heat signature of the gun during and after firing as a result of the insulative properties.

DETAILED DESCRIPTION

Figure 11:
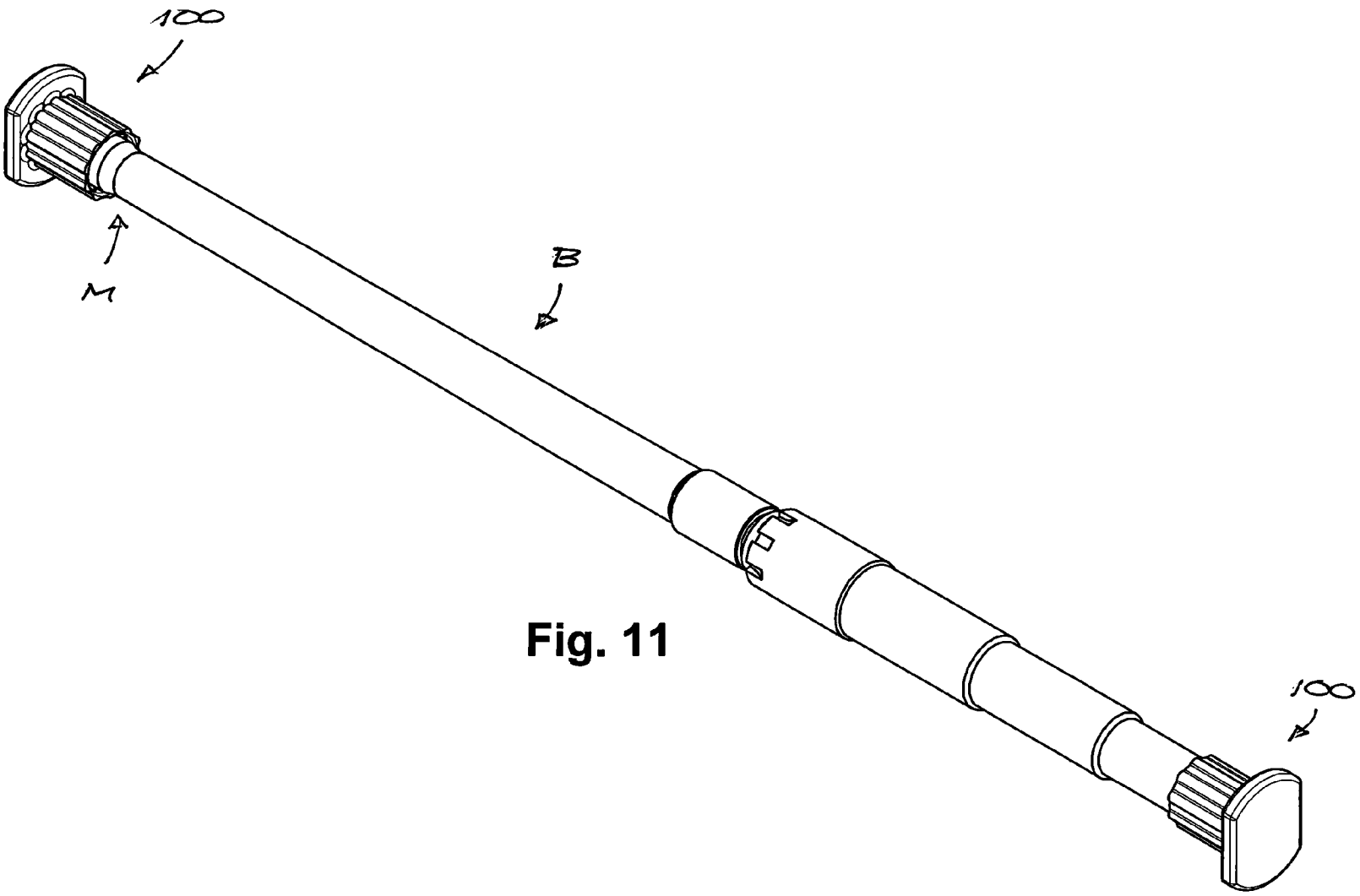
FIG. 11 is a perspective view of a gun barrel with gun barrel caps of the present disclosure installed on the gun barrel.

As shown in the accompanying FIGS. 1-11, a barrel cap 100 is configured to fit on the muzzle ends M of different types of gun barrels, including but not limited to military rifles and machine guns such as the AR15, M16, M4, M240, M249 (SAW). And as shown in FIG. 11, a barrel cap 100 can be fit upon the muzzle end of a barrel removed from a gun, such as for example a M249 SAW barrel. The barrel cap 100 has a body 101 which has a generally cylindrical wall 102 with an exterior surface 103 and an interior surface 104. The cylindrical wall 102 extends axially from an end wall 105 which extends radially beyond the outer surface 103 of the cylindrical wall 102.

A first group of axially aligned and radially arrayed ridges 110 are formed to extend from the interior surface 104 of the cylindrical wall 102. Each ridge 110 has an apex 111 which provides a contact surface for the exterior of a gun barrel at the muzzle, as illustrated. The multiple contact areas 111 of the ridges 110 provide a combined gripping contact with a gun barrel B of a gun G so that the barrel cap 100 is thereby tightly secured upon the barrel.

Figures 1, 2:
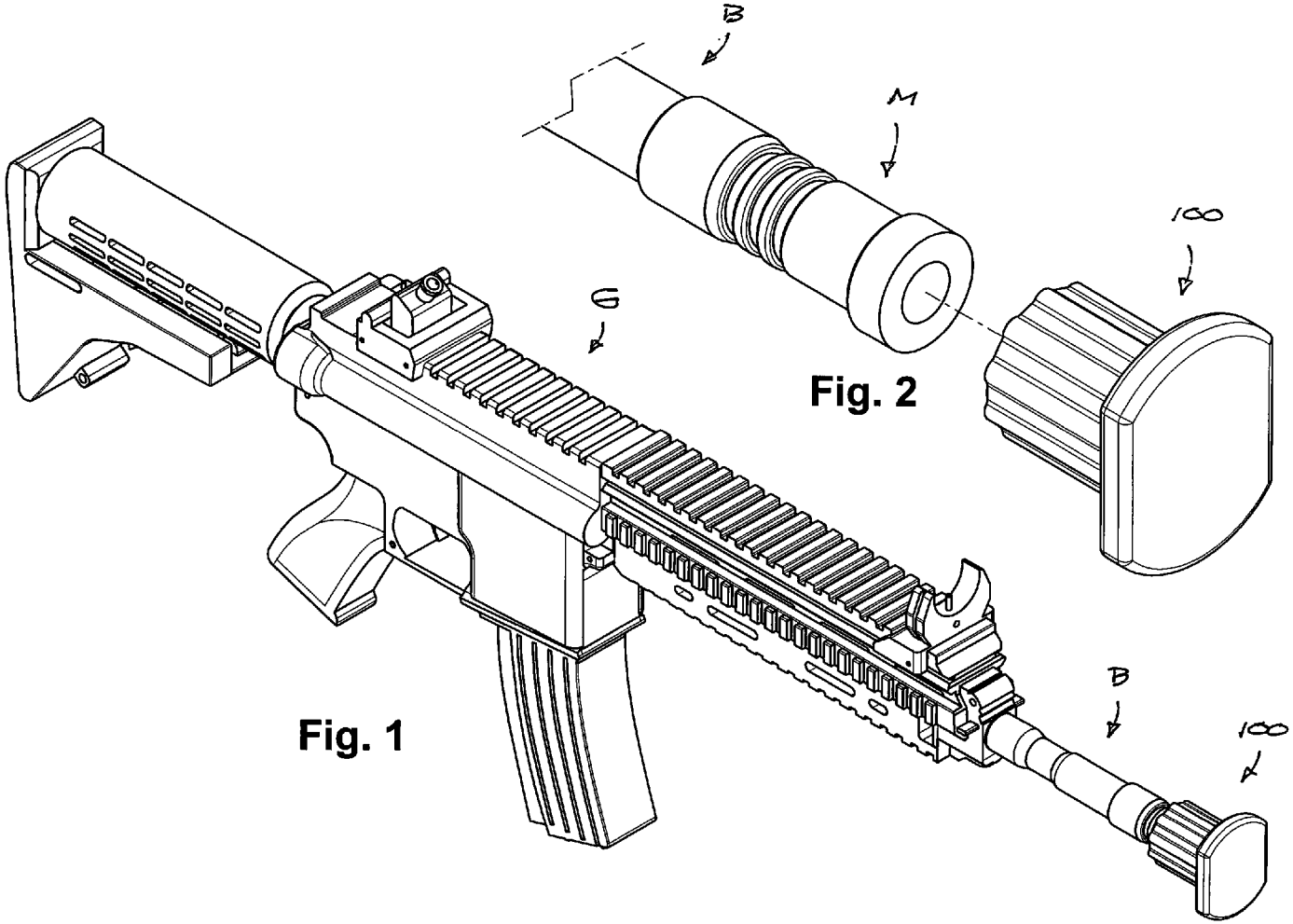
FIG. 1 is a perspective view of a gun with a gun barrel cap of the present disclosure attached to a muzzle of the gun barrel.
FIG. 2 is a partial perspective view of the gun muzzle and barrel cap shown in FIG. 1.
Figures 3, 4:
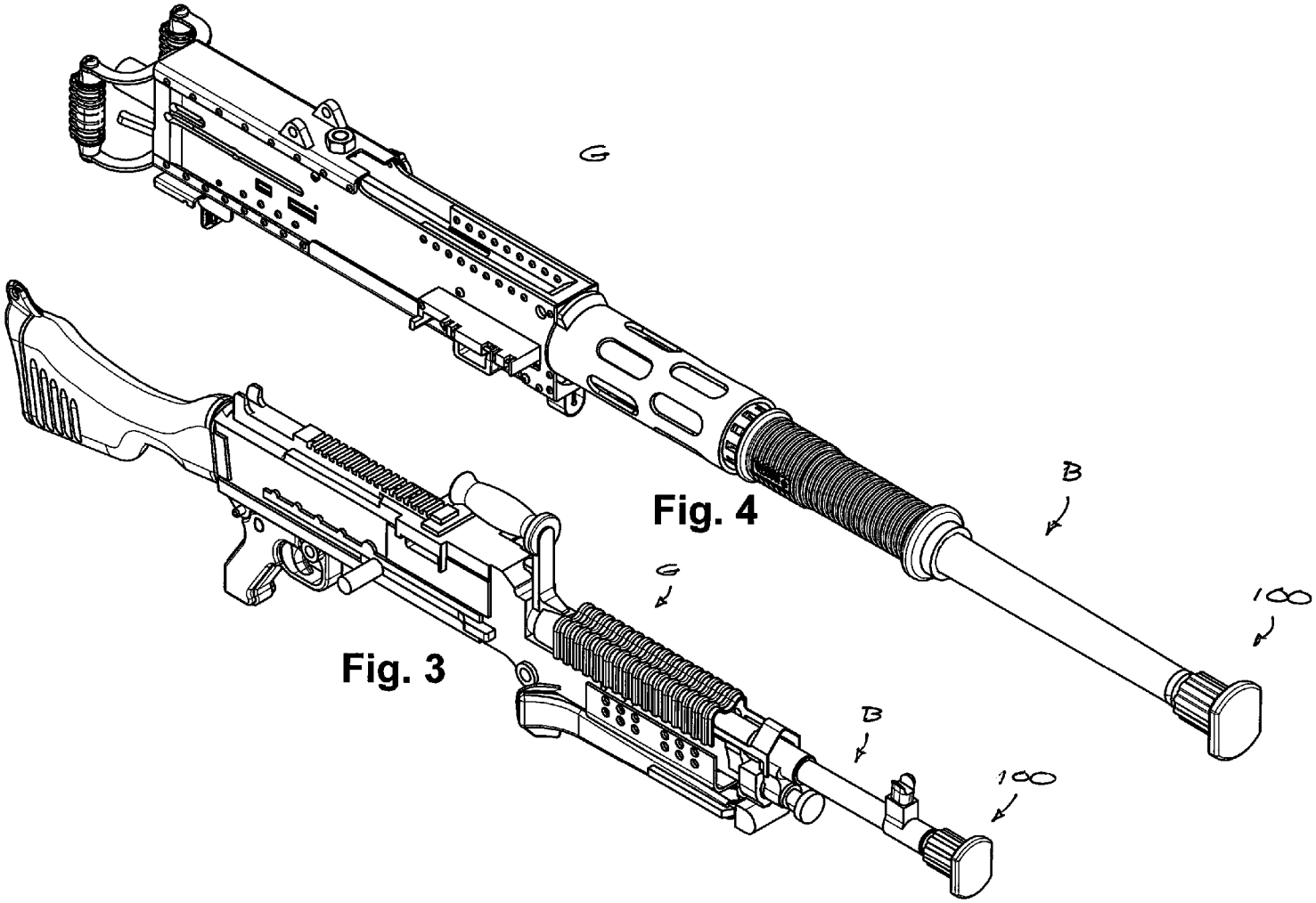
FIG. 3 is a perspective view of a gun with a gun barrel cap of the present disclosure attached to a muzzle of the gun barrel.
FIG. 4 is a perspective view of a gun with a gun barrel cap of the present disclosure attached to a muzzle of the gun barrel.
Figure 7:
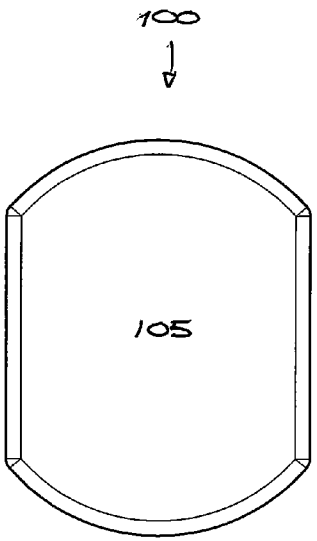
FIG. 7 is an end view of the gun barrel cap of the present disclosure.
Figure 6:
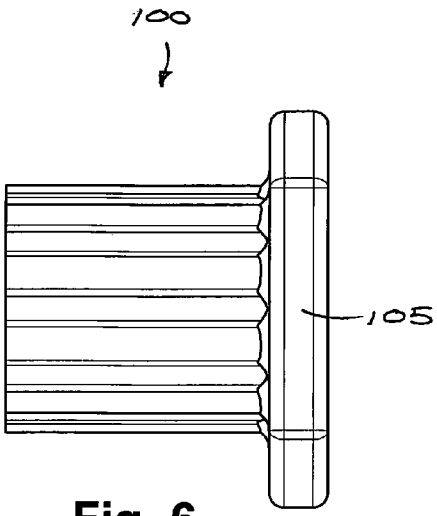
FIG. 6 is a profile view of a gun barrel cap of the present disclosure.
Figure 5:
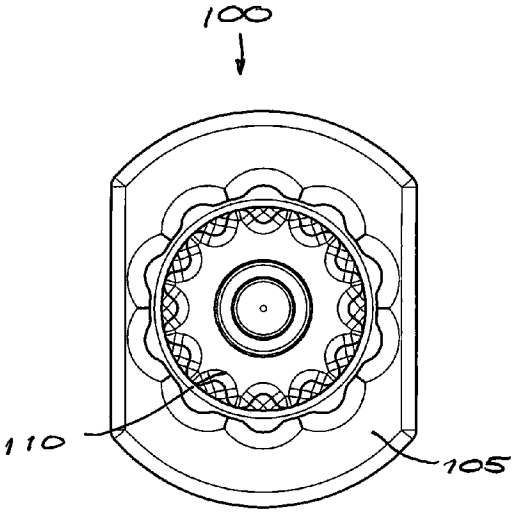
FIG. 5 is an end view of a gun barrel cap of the present disclosure.
Figure 10:
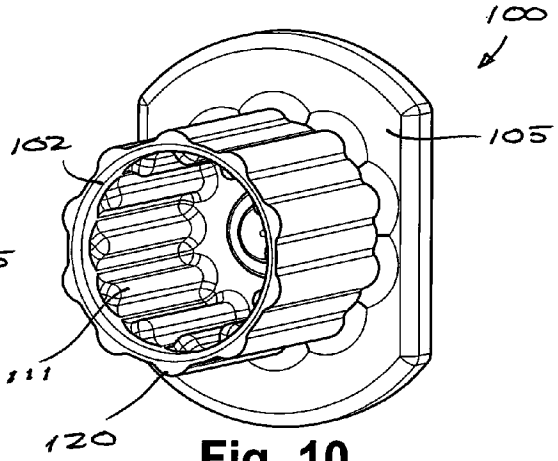
FIG. 10 is a perspective view of the gun barrel cap of the present disclosure.
Figure 9:
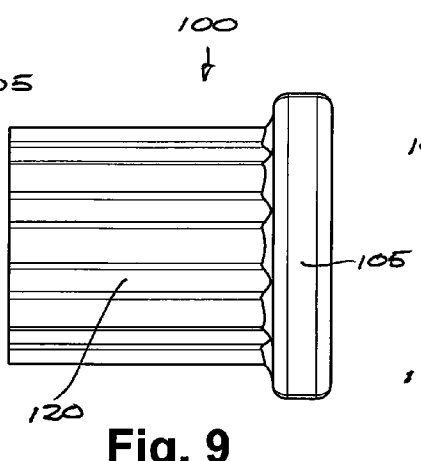
FIG. 9 is a profiled view of the gun barrel cap of the present disclosure.
Figure 8:
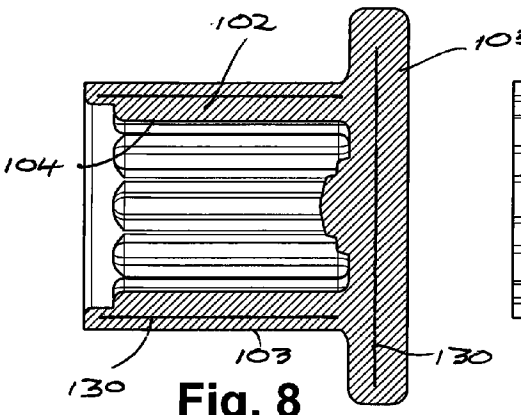
FIG. 8 is a cross-sectional view of the gun barrel cap of the present disclosure.

A second group of axially aligned and radially arrayed ridges 120 are formed to extend from the exterior surface 103 of the cylindrical wall 102. The ridges 120 provide a positive tactile contour to the exterior of the barrel cap 100 for manipulation for installing and removing the barrel cap 100 from a barrel muzzle. Also, the extension of the end wall 105 beyond the cylindrical wall 102 and the ridges 120 provides a gripping structure for manipulating the barrel cap 100 upon installation and removal. As shown in FIG. 8, internal reinforcement 130 can be incorporated into the cylindrical wall 102 and/or the end wall 105, for example in the form of a metal or plastic or other rigid or semi-rigid material r around over which the moldable material of the barrel cap 100 is formed.

An internal pilot plug 108 can be formed on an interior side of the end wall 105 and within the cylindrical wall 102 for fitment within the opening at the muzzle end of the barrel to provide even tighter engagement of the barrel cap 100 with a barrel.

The invention claimed:

1. A barrel cap comprising:

a body having a generally cylindrical wall which extends from a first side of a generally planar end wall, and an opening defined by the generally cylindrical wall opposite the generally planar end wall, the opening configured to receive a muzzle of a gun barrel within the generally cylindrical wall;

a first set of ridges extending from an interior side of the generally cylindrical wall and axially aligned with the generally cylindrical wall, each of the ridges of the first set of ridges having an apex configured for contact with an exterior surface of a gun barrel proximate to a muzzle end of the gun barrel;

a second set of ridges extending from an exterior side of the generally cylindrical wall and axially aligned with the generally cylindrical wall, and the end wall extending radially beyond the second set of ridges.

* * * * *